US012123218B1

(12) United States Patent
Zhao et al.

(10) Patent No.: US 12,123,218 B1
(45) Date of Patent: Oct. 22, 2024

(54) VARIABLE FRICTION ENERGY DISSIPATION PREFABRICATED SEISMIC-DAMPING PARTITION WALL-FRAME STRUCTURE AND CONSTRUCTION METHOD THEREFOR

(71) Applicants: SOUTH CHINA UNIVERSITY OF TECHNOLOGY, Guangzhou (CN); BEIJING BRACE DAMPING ENGINEERING TECHNOLOGY CO., LTD, Beijing (CN)

(72) Inventors: Junxian Zhao, Guangzhou (CN); Hao Qin, Guangzhou (CN); Zhaoxun Yuan, Guangzhou (CN); Wei Han, Guangzhou (CN)

(73) Assignees: SOUTH CHINA UNIVERSITY OF TECHNOLOGY, Guangzhou (CN); BEIJING BRACE DAMPING ENGINEERING TECHNOLOGY CO., LTD, Beijing (CN)

( * ) Notice: Subject to any disclaimer, the term of this patent is extended or adjusted under 35 U.S.C. 154(b) by 0 days.

(21) Appl. No.: 18/740,535

(22) Filed: Jun. 12, 2024

Related U.S. Application Data

(63) Continuation of application No. PCT/CN2023/128633, filed on Oct. 31, 2023.

(30) Foreign Application Priority Data

Jul. 28, 2023 (CN) ..... 202310941227.5

(51) Int. Cl.
*E04H 9/02* (2006.01)
*E04B 2/00* (2006.01)
(Continued)

(52) U.S. Cl.
CPC ..... *E04H 9/021* (2013.01); *E04C 2/30* (2013.01); *E04C 2/44* (2013.01); *E04C 2002/001* (2013.01)

(58) Field of Classification Search
CPC ..... E04H 9/021; E04H 9/028; E04H 9/027; E04H 9/022; E04H 9/0237; E04C 2/30; E04C 2/44; E04C 2002/001
(Continued)

(56) References Cited

U.S. PATENT DOCUMENTS 3,842,558 A * 10/1974 Scholz ..... E04C 2/044 52/293.3
5,065,558 A * 11/1991 Boatsman ..... E04B 1/34315 52/848
(Continued)

FOREIGN PATENT DOCUMENTS

CN 102268900 12/2012
CN 205577143 9/2016
(Continued)

OTHER PUBLICATIONS

"International Search Report (Form PCT/ISA/210) of PCT/CN2023/128633," mailed on Apr. 2, 2024, pp. 1-5.
"Written Opinion of the International Searching Authority (Form PCT/ISA/237) of PCT/CN2023/128633," mailed on Apr. 2, 2024, with English translation thereof, pp. 1-6.

*Primary Examiner* — Brian E Glessner
*Assistant Examiner* — Adam G Barlow
(74) *Attorney, Agent, or Firm* — JCIPRNET

(57) ABSTRACT

The present invention relates to a variable friction energy dissipation prefabricated seismic-damping partition wall-frame structure and a construction method therefor. The variable friction energy dissipation prefabricated seismic-damping partition wall-frame structure includes a peripheral frame, prefabricated seismic-damping partition wall panels,
(Continued)

rubber pads, a friction seismic-damping layer, horizontal force transfer members and a steel angle restraining members. The sliding friction of the partition wall can be significantly improved with increase of an inter-story drift, so that the partition wall has a larger hysteretic area and a higher energy dissipation capacity and can provide the structure with a relatively high additional damping ratio, so as to alleviate a seismic action. In addition, integral damage control of the partition wall can be better achieved, and the energy dissipation capacity of the partition wall under bidirectional seismic actions can be guaranteed.

20 Claims, 8 Drawing Sheets

(51) Int. Cl.
*E04C 2/30* (2006.01)
*E04C 2/00* (2006.01)

(58) Field of Classification Search
USPC ..... 52/125.4, 167.1, 167.7, 167.8, 302.1, 698, 52/707
See application file for complete search history.

(56) References Cited

U.S. PATENT DOCUMENTS

| | | | | |
|---|---|---|---|---|
| 12,071,763 | B2 * | 8/2024 | Robinson | E04C 2/043 |
| 2002/0069602 | A1 * | 6/2002 | Blanchet | E04H 9/14 52/745.1 |
| 2007/0056242 | A1 * | 3/2007 | Sample | E04B 1/41 52/698 |
| 2013/0199868 | A1 * | 8/2013 | Bergiadis | E04B 1/84 29/896.2 |
| 2015/0135617 | A1 * | 5/2015 | Liu | E04B 2/7448 52/302.1 |
| 2016/0194867 | A1 * | 7/2016 | Ahmadi | E04H 9/025 52/167.7 |
| 2018/0251995 | A1 * | 9/2018 | Varnum | E04H 9/021 |
| 2020/0385982 | A1 * | 12/2020 | Rivas | E04B 5/02 |

FOREIGN PATENT DOCUMENTS

| | | |
|---|---|---|
| CN | 215907103 | 2/2022 |
| CN | 114575493 | 6/2022 |
| CN | 115405023 | 11/2022 |
| CN | 218970333 | 5/2023 |
| CN | 219365021 | 7/2023 |
| JP | H11181923 | 7/1999 |
| JP | 2000129951 | 5/2000 |

* cited by examiner

VARIABLE FRICTION ENERGY DISSIPATION PREFABRICATED SEISMIC-DAMPING PARTITION WALL-FRAME STRUCTURE AND CONSTRUCTION METHOD THEREFOR

CROSS-REFERENCE TO RELATED APPLICATIONS

This application is a continuation of international PCT application serial no. PCT/CN2023/128633, filed on Oct. 31, 2023, which claims the priority benefit of China application no. 202310941227.5, filed on Jul. 28, 2023. The entirety of each of the above-mentioned patent applications is hereby incorporated by reference herein and made a part of this specification.

TECHNICAL FIELD

The present invention relates to the technical field of seismic energy dissipation of civil construction and particularly relates to a variable friction energy dissipation prefabricated seismic-damping partition wall-frame structure and a construction method therefor.

BACKGROUND

Partition wall is a crucial component of the frame structure, providing functions such as enclosure, insulation, moisture resistance, and soundproofing. In a seismic-resistance design of a structure, modeling of the partition wall is usually neglected. The partition wall is only simplified to a line load, and an influence of the partition wall on the structure is considered by way of period reduction. However, the above design method actually neglects the characteristic that the partition wall is vulnerable owing to its brittleness. A strong restraining effect between the partition wall and a peripheral frame structure will, on the one hand, causes severe damage of the partition wall in an earthquake, and on the other hand, significantly increase the lateral stiffness of the structure, so as to change the plane stiffness and the vertical stiffness of the original structure, so that a weak story and a short column of the structure may be damaged, which is contrary to implementation of a design philosophy of "strong column and weak beam".

"To improve the ability of preventing and treating seismic disaster risks and enhance the urban resilience" is one of major tasks in the National Earthquake Disaster Reduction Planning in the 14$^{th}$ Five-Year Plan. Therefore, to implement damage control and enhance resilience of the partition wall in the earthquake is of crucial scientific significance. To achieve the above object, scholars at home and abroad study the damage control of the partition wall in terms of "reinforcing" and "weakening". A "reinforcing" solution prevents the wall from being severely damaged by means of "hard resistance", and major implementation methods include: arranging reinforcing bars or studs (as shown in FIG. 1) in the wall, reinforcing the wall space with a fiber composite enhanced material, and the like. A "weakening" solution implements damage control of the partition wall based on an idea that the partition wall and the frame are "decoupled", and major implementation methods include: changing a joint construction at a boundary of a wall frame (such as flexible connection), an inter-wall joint construction (arranging a plurality of preset sliding joints in the wall, as shown in FIG. 2 and FIG. 3) and the like. It can be found by comparing an existing technical solution with a related test result that when the "weakening" solution is used for damage control and resilience enhancement for the partition wall, its effect is usually superior to that of the "reinforcing" solution, but there are still following problems needed to be further perfected and solved:

1. Weak Seismic-Damping Ability

Sliding friction energy dissipation between the partition walls is the major method to implement the seismic-damping function of the partition wall. The energy dissipation capacity of the sliding friction energy dissipation is associated with a normal force and a friction coefficient of a sliding friction surface. Because the partition wall has a tendency of lightweight development, in the existing technical solution (for example, a patent with application No.: CN 202210367123.3), the partition wall has a certain seismic-damping function by paving a friction layer (improving the friction coefficient). However, it is to be specified that as shown in FIG. 4, most friction-displacement envelope curves provided in the existing technical solution are flatly rectangular with relatively limited energy dissipation capacities. When the structure is subjected to middle earthquakes or large middle earthquakes, the additional damping ratio provided by the existing technical solution to the structure is often small, so that the seismic action is hardly reduced effectively. Therefore, to predict and design a hysteretic behavior based on increase of the friction coefficient and to further improve the normal force of the sliding friction surface without changing the lightweight of the partition wall, to enable the partition wall to be capable to provide relatively high additional damping ratio to the structure is one of important research directions to achieve energy dissipation and seismic reduction and resilience enhancement of the partition wall.

2. Difficult Damage Control

To implement the overall damage control of the partition wall, in the existing technical solution (such as patents with application No. CN 201110156375.3 and CN 202210367123.3), the partition wall is usually divided into a plurality of partition wall units. When an earthquake happens, the partition wall units will slide along the preset sliding joints among the units and a plurality of sliding through cracks (as shown in FIG. 2 and FIG. 3) are left in the middle of the wall space, which, to a certain extent, will affects the post-earthquake repair time and cost. For crucial fortification buildings needed to undertake tasks such as disaster relief and treatment and curing after the earthquake, equipment pipelines are usually buried in the partition wall. Once the partition wall in the existing technical solution (many preset sliding joints are arranged in the partition wall) slides in the earthquake, it is largely probable that the equipment pipelines in the partition wall will be damaged, which further affects works of disaster relief and treatment and curing after the earthquake.

3. Poor Bidirectional Cooperation

Under actual seismic conditions, partition walls are subjected to bidirectional forces, where in-plane and out-of-plane behaviors influence and constrain each other. Therefore, partition walls should be considered as non-structural components with in-plane displacement and out-of-plane acceleration characteristics. From this perspective, controlling seismic damage to partition walls is more challenging compared to structural components. However, in the existing technical solution (such as patents with application No. CN 201110156375.3 and CN 202210367123.3), the seismic-damping behavior of the partition wall under an in-plane load effect is only considered rather than the behavior of the partition wall under the effect of in-plane and out-plane bidirectional loads. Therefore, the partition wall will quit work too early under the actual seismic action with a certain probability, so that an expected energy dissipation and seismic-damping target cannot be implemented.

4. Low Construction Cooperation

With popularization of building assembly, replacement of a conventional masonry partition wall with a prefabricated partition wall panel has been a development tendency in the current industrial field. However, seismic energy dissipation performance studies are still conducted in the existing technical solutions based on the conventional masonry partition wall. Although a certain amount of studies have been conducted based on the prefabricated partition wall panel at present, a transverse prefabricated partition wall panel or a large-area prefabricated partition wall panel is often used. When the transverse prefabricated partition wall panel is used, it is often considered to be suitable for an external wall of a plant building with a small out-plane bearing force and a small applicable span; and when the large-area prefabricated partition wall panel is used, it is often considered to be inconvenient for the partition wall panel members to be on site and installed. In addition, by summarizing the existing technical solutions, it can be found that a part of seismic-damping partition wall technologies are more suitable for new buildings, for example, the buildings in which connectors and connecting ribs need to be pre-buried. However, the current building area in China has exceeded 72 billion square meters, where 30%-50% of the buildings have the problems of reduced safety or deteriorated functions and the like. Therefore, to combine the seismic-damping partition wall technologies with the improvement of the seismic-resistance performance of the existing buildings is an important development direction in the technical field.

SUMMARY

To overcome defects in the prior art, an object of the present invention is to provide a variable friction energy dissipation prefabricated seismic-damping partition wall-frame structure and a construction method therefor. The overall damage control capacity and the bidirectional deformation cooperation capacity of the partition wall can be improved while adapted to an existing construction process and improving the structural assembly rate. By means of rotation of joints of a frame and deformation between stories, the partition wall has the characteristics of variable friction and variable damping and energy dissipation, so that the seismic action is effectively reduced, and the resilience between the partition wall and the structure is improved.

The technical solution provided by the present invention is shown in FIG. 5. The technical solution, in combination with an existing seismic-resistance design method, is designed as a decoupling working state for minor earthquake and variable friction seismic-damping working states for moderate and strong earthquakes. The two working states and a working principle designed in the present invention are explained below.

The decoupling working state for minor earthquake: when the variable friction energy dissipation prefabricated seismic-damping partition wall-frame structure is subjected to the seismic action of a minor earthquake, the partition wall enters the decoupling working state for minor earthquake. In the working state, the partition wall is subjected to friction hysteretic energy dissipation under an action of a hysteretic force of the earthquake, and the sliding friction is approximately equal to a product of the gravity of the wall and the friction coefficient of the sliding surface at this time. Since the friction is usually small in the state, and the left and right side and the top of the partition wall are flexibly connected to the peripheral frame mainly, the restraining effect between the partition wall and the frame is released significantly, and the structure can be approximately equivalent to a bare frame system.

The variable friction seismic-damping working states for moderate and strong earthquakes: when the variable friction energy dissipation prefabricated seismic-damping partition wall-frame structure is subjected to the seismic action of moderate and strong earthquakes, the partition wall enters the variable friction seismic-damping working state. FIG. 6 is a schematic diagram of the present invention before entering the variable friction seismic-damping working state. FIG. 7 is a schematic diagram of the present invention entering the variable friction seismic-damping working state. In the working state, a rubber pad at the upper corner of the partition wall panel is pressed as the joints of the frame rotate, so that the partition wall receives the pressure caused by rotation of the joints, and therefore, the normal force of the friction surface is increased, and the normal force is increased with increase of the inter-story drift of the structure. A force isolated body is taken for the partition wall. As shown in FIG. 8, the partition wall is subjected to a horizontal thrust of the peripheral frame, a vertical pressure transferred by the rubber pad, a horizontal friction and a normal force of the friction surface and the dead weight of the partition wall. Compared with a constant friction energy dissipation mechanism, in the technical solution provided by the present invention, the friction damping energy dissipation of the partition wall is improved with increase of the seismic intensity while the restraining effect of the wall frame can be significantly released, so that the additional damping ratio of the structure is increased, and the seismic action is reduced. Problems such as significant rigidity sudden change, large top-story drift, ultralimit inter-story drift and irregular torsion caused by the conventional partition wall are avoided.

The technical solution provided by the present invention can effectively implement overall damage control of the partition wall based on the two working states and arrangement of shear members among the partition wall panels, i.e., the partition wall has no inter-panel sliding joints or the panel has no large-area severe damage under the seismic action. Specifically, because the partition wall can implement better in-plane damage control, the out-plane bearing force will not be significantly reduced as a result of large in-plane damage of the partition wall due to the action of the out-plane seismic inertia force, so that the probability of out-plane collapse of the partition wall can be effectively reduced. Moreover, when the structure is subjected to the bidirectional seismic actions, the variable friction energy partition prefabricated seismic-damping partition wall provided by the present invention is allowed to tilt to a certain extent without significantly affecting the implementation of the variable friction energy dissipation mechanism of the partition wall.

Specifically, to implement the above working states and objects, the present invention adopts the following technical solution: the variable friction energy dissipation prefabricated seismic-damping partition wall-frame structure includes a peripheral frame, prefabricated seismic-damping partition wall panels, rubber pads, friction seismic-damping layer, horizontal force transfer members and steel angle restraining members.

The peripheral frame includes a frame top beam, a frame bottom beam, a frame left column and a frame right column.

The frame top beam and the frame bottom beam are equal in length and are parallel. Both ends of the frame top beam and the frame bottom beam are reliably connected to the frame left column and the frame right column respectively.

The prefabricated seismic-damping partition wall includes two side prefabricated seismic-damping partition wall panels and a plurality of middle prefabricated seismic-damping partition wall panels.

A basic shape of each of the side prefabricated seismic-damping partition wall panels is a vertically cuboid strip panel with a notch in an upper corner and an edge covered steel angle on a lower portion. Detailing reinforcing bars are provided inside inside the wall panel and shear members are arranged along both sides of the height of the wall panel.

Further, a rubber pad is installed at the notch. The rubber pad successively includes an upper closing board, rubber, and a lower closing board, and rigidity can be designed according to related specifications of current seism-isolating rubber pads as needed. By providing the rubber pads, damage of the wall panels and the clamping members can be reduced, so that friction energy dissipation can be designed and predicted.

Further, the rigidity of the upper closing board is usually great and a protrusion is arranged at the top. The protrusion is in contact with a bottom surface of the frame top beam. The lower closing board and the notch can be reliably connected by means of an epoxy adhesive or in other ways. It is to be noted that by providing the protrusion and the upper closing board, the rubber pads are all in an approximately uniform stressed state under the in-plane and out-plane load effects, so that the vertical rigidity of the rubber pads is designable and predictable.

Further, the edge covered steel angle is located on both sides of the bottom of the side prefabricated seismic-damping partition wall panel, so that stress concentration at the bottom of the prefabricated seismic-damping partition wall panel under the bidirectional load effect can be avoided, and the prefabricated seismic-damping partition wall panel is in welded connection to the detailing reinforcing bars.

Further, the detailing reinforcing bars can be designed according to a current lightweight partition wall panel specification. The shear members are in welded connection to the detailing reinforcing bars. The edge covered steel angle, the detailing reinforcing bars, and the shear members jointly form a reinforcement cage framework of the side prefabricated seismic-damping partition wall panel.

The middle prefabricated seismic-damping partition wall panel is the same as the side prefabricated seismic-damping partition wall panel in structure, without the notch in the upper corner and the rubber pads.

Further, the middle prefabricated seismic-damping partition wall panel and the side prefabricated seismic-damping partition wall panel are spliced and the plurality of middle prefabricated seismic-damping partition wall panels are spliced. The shear members are aligned with each other and close fit each other during the splicing between the middle prefabricated seismic-damping partition wall panel and the side prefabricated seismic-damping partition wall panel and between the plurality of middle prefabricated seismic-damping partition wall panels.

Further, reliable connection among the prefabricated seismic-damping partition wall panels is implemented by connection of weld joints after the shear members are in abutting joint. Uniform pass-length welding is applied to the weld joint connection along the gaps of the shear members in close fit.

The prefabricated seismic-damping partition wall panel is located at the top of the frame bottom beam, the friction seismic-damping layer is arranged between the prefabricated seismic-damping partition wall panel and the frame bottom beam, and the friction seismic-damping layer can be formed by paving low strength mortar on the top surface of the frame bottom beam.

Further, the horizontal force transfer members are arranged at tops of the gaps among the side prefabricated seismic-damping partition wall panel, the frame left column and the frame right column, and the horizontal force transfer members can be formed by pouring high strength concrete (or high strength mortar and the like) in the gaps through a formwork. It is to be noted that the horizontal force transfer clamping member is a major force transfer component through which the prefabricated seismic-damping partition wall panel is subjected to sliding friction under the effect of the horizontal reciprocating force of the earthquake.

Further, other gaps among the prefabricated seismic-damping partition wall panel, the frame top beam, the frame left column and the frame right column are filled with a flexible material, and the flexible material shall have thermal insulation, sound insulation, moisture-proofing functions and the like.

Further, the steel angle restraining members can be installed between the prefabricated seismic-damping partition wall panel and the peripheral frame according to a current lightweight partition wall panel specification, so as to ensure that the prefabricated seismic-damping partition wall panel has a reliable out-plane bearing capacity.

The present invention further discloses a construction method for a variable friction energy dissipation prefabricated seismic-damping partition wall-frame structure, including the following construction steps:

- S1: completing manufacturing of prefabricated seismic-damping partition wall panels in a prefabrication factory, and transporting the prefabricated seismic-damping partition wall panels to a construction site;
- S2: completing construction of a peripheral frame, and positioning the prefabricated seismic-damping partition wall panels in the frame;
- S3: synchronously installing the prefabricated seismic-damping partition wall panels, friction seismic-damping layer and steel angle restraining members;
- S4: installing horizontal force transfer members; and
- S5: filling other gaps between the peripheral frame and the prefabricated seismic-damping partition wall panels with a flexible material.

Compared with the prior art, the present invention at least achieves the following beneficial effects:

1. Improvement of Energy Dissipation and Seismic-Damping Ability

A variable friction energy dissipation prefabricated seismic-damping partition wall-frame structure has the decoupling working state for minor earthquake and variable friction seismic-damping working states for moderate and strong earthquakes. Compared with the existing technical solution, the restraining effect of the wall frame can be neglected in the minor earthquake, the structure is approximately equivalent to a pure frame system, and less reduction or no reduction of a natural vibration period of the structure can be achieved in the structure design stage, so that the structural design is optimized; in the moderate and strong earthquakes, the sliding friction energy dissipation capacity provided by the present invention is improved with increase of the rotation of the joints and the inter-story drift. Therefore, the present invention has the characteristic that the greater the seismic action is, the stronger the energy dissipation seismic-damping capacity, and the higher the additional damping ratio is. Problems such as insufficient energy dissipation capacity, difficulty to predict the hysteretic behavior, rigidity sudden change, large top-story drift, ultra-limit inter-story drift and irregular torsion suspectable to be caused by the conventional partition wall can be solved effectively.

2. Implementation of Overall Damage Control

The variable friction energy dissipation prefabricated seismic-damping partition wall-frame structure implements decoupling between the partition wall and the frame, so that the restraining effect of the wall frame can be effectively released, and large-area damage due to too large rigidity of the partition wall is avoided. Compared with the existing technical solution, based on the concept that the sliding surface is placed at the bottom and the shear members are arranged among the partition wall panels, the overall damage control of the partition wall can be implemented to the maximum extent, the plurality of sliding through joints are prevented effectively in the wall space of the partition wall, so that it is expected to reduce the post-seismic repair time and cost of the structure to a certain extent, which fits a construction target of "resilient urban and rural areas".

3. Improvement of Bidirectional-Cooperation Energy Dissipation

The variable friction energy dissipation prefabricated seismic-damping partition wall-frame structure can implement better in-plane damage control, so that the out-plane bearing force will not be significantly reduced as a result of large in-plane damage of the partition wall due to the action of the out-plane seismic inertia force. Compared with the existing technical solution, when the structure is subjected to the bidirectional seismic actions, the partition wall provided by the present invention is allowed to tilt to a certain extent without significantly affecting the implementation of the variable friction energy dissipation mechanism of the partition wall, so that a target that the in-plane energy dissipation capacity is approximate to a bidirectional energy dissipation capacity can be substantially implemented.

4. Adaptability to Existing Construction Conditions

The variable friction energy dissipation prefabricated seismic-damping partition wall-frame structure is formed by splicing the vertical prefabricated partition wall panels. Therefore, compared with the existing technical solution, the present invention can be better applied to various buildings such as residences, offices and commercial buildings. Additionally, because the present invention has the characteristics that it has small intervention to the existing building and does not change the stress of the structural members of the existing building, thus, it can still be applied to improving the seismic-resistance performance of the existing building.

BRIEF DESCRIPTION OF DRAWINGS

To illustrate the technical solutions in the specific implementation modes of the present invention or in the prior art more clearly, a brief introduction to the drawings required for the description of the specific implementation modes or the prior art will be provided below. Apparently, the drawings in the following description are some of the implementation modes of the present invention, and those of ordinary skill in the art may still derive other drawings from these drawings without making creative efforts.

Figure 1:
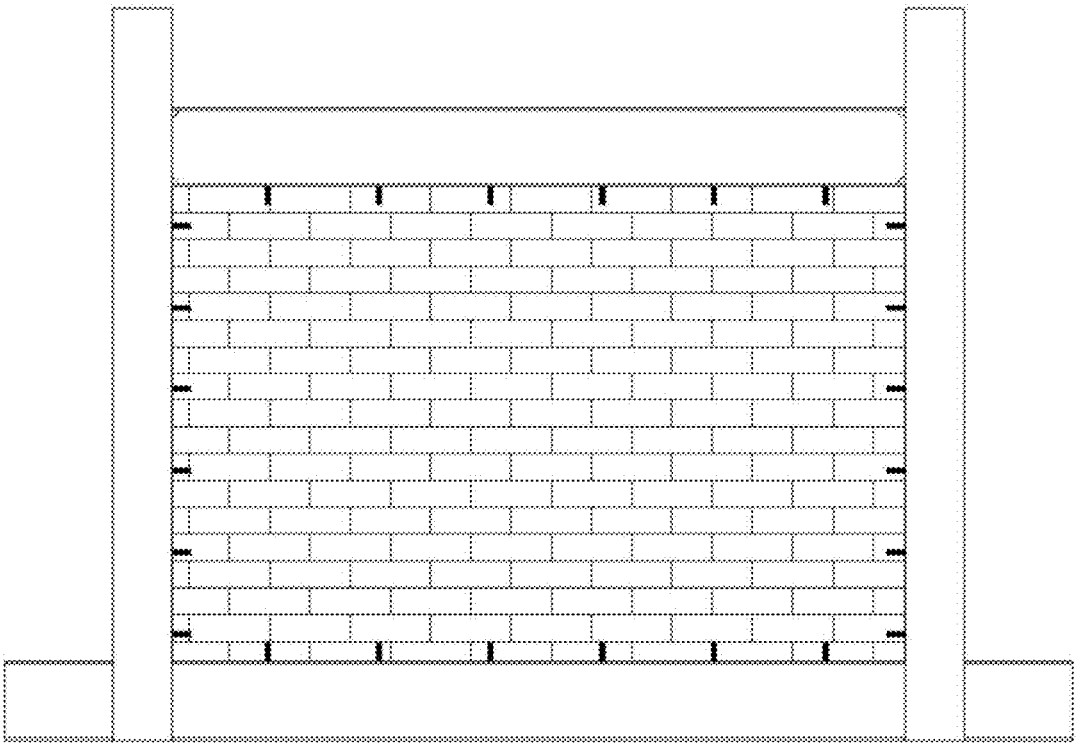
FIG. 1 is a schematic diagram of a "reinforcing" solution in an existing technical solution.
Figure 2:
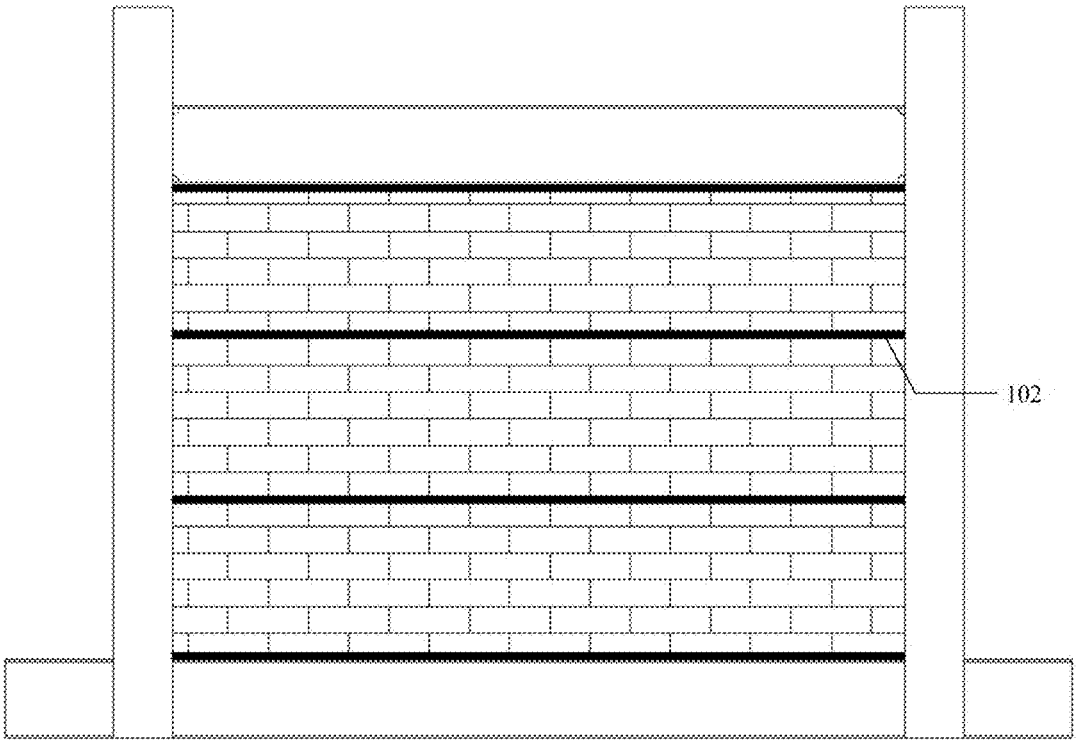
FIG. 2 is a schematic diagram 1 of a "weakening" solution in the existing technical solution.
Figure 3:
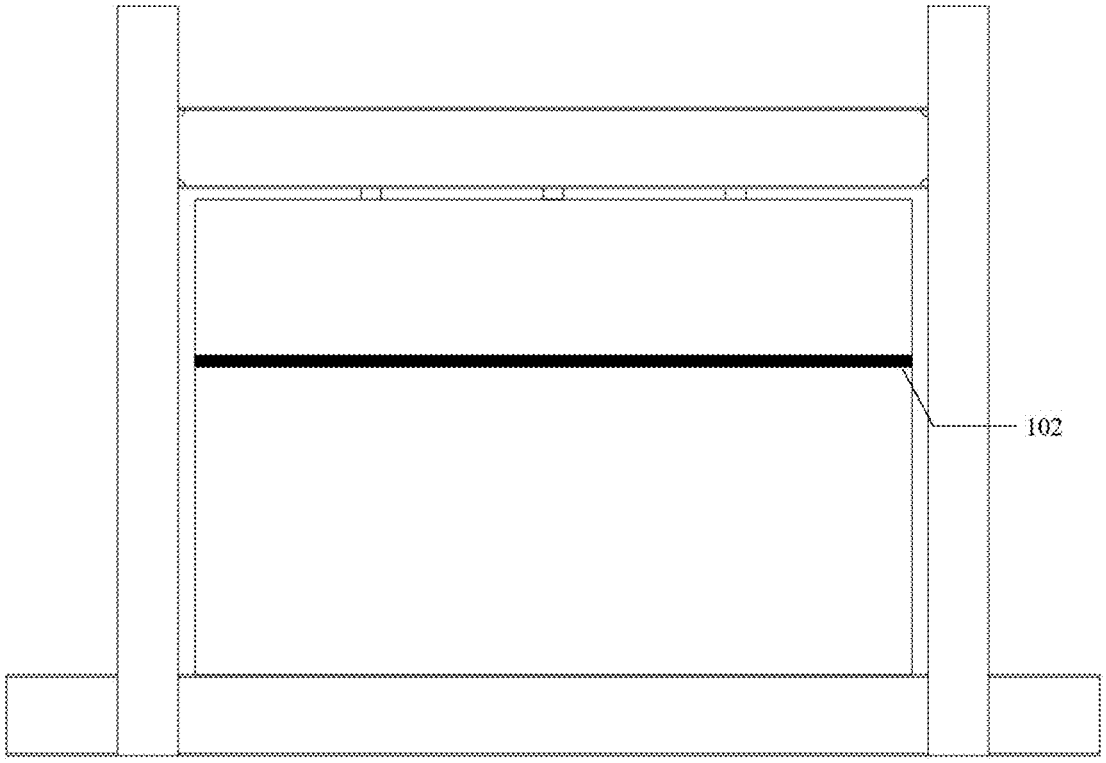
FIG. 3 is a schematic diagram 2 of a "weakening" solution in the existing technical solution.

In the drawings, 1, peripheral frame; 11, frame top beam; 12, frame bottom beam; 13, frame left column; 14, frame right column; 15, frame beam-column joint; 2, side prefabricated seismic-damping partition wall panel; 21, vertical stress reinforcing bar of side partition wall panel; 22, transversely distributed reinforcing bar of side partition wall panel; 23, first edge covered steel angle; 24, first shear member; 3, rubber pad; 31, upper closing board; 32, rubber; 33, lower closing board; 34, protrusion; 4, middle prefabricated seismic-damping partition wall panel; 41, vertical stress reinforcing bar of middle partition wall panel; 42, transversely distributed reinforcing bar of middle partition wall panel; 43, second edge covered steel angle; 44, second shear member; 5, horizontal force transfer clamping member; 6, steel angle restraining member; 7, friction seismic-damping layer; 101, stud; 102, preset sliding joint.

DETAILED DESCRIPTION OF EMBODIMENTS

It is to be noted that the detailed description below is exemplary and is intended to further describe the application. Unless specified otherwise, all technical and scientific terms used herein have the same meaning as commonly understood by those of ordinary skill in the art to which the application belongs.

It should be noted that the terms used herein are merely to describe specific implementation modes rather than being intended to limit the exemplary implementation modes according to the present application. As used herein, unless otherwise specified in the context, the singular form is further intended to include plural form. In addition, it is to be further understood that when the terms "comprise" and/or "include" are used in the description, it indicates that there are features, steps, operations, apparatuses, assemblies and/or their combinations.

For the convenience of narration, words such as "upper", "lower", "left" and "right" in the present invention only represent consistence with upper, lower, left and right directions of the drawings rather than limiting the structure. They are only used for convenient description of the present invention and simplification of the description rather than indicating or implying that the indicated devices or components must have specific orientations and are configured and operated in the specific orientations. Therefore, they cannot be construed as limitations to the present invention.

Embodiment 1

Figure 5:
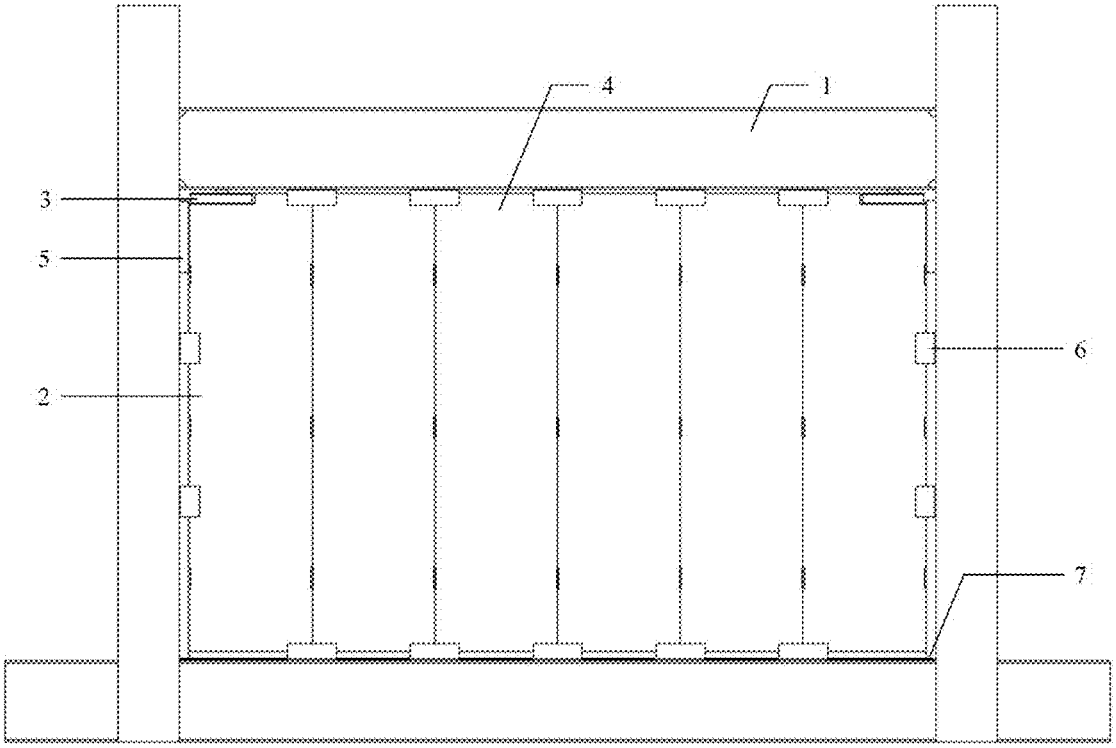
FIG. 5 is a schematic diagram of an overall configuration of a seismic-damping partition wall-frame structure provided in an embodiment of the present invention.

As shown in FIG. 5, the present invention provides a variable friction energy dissipation prefabricated seismic-damping partition wall-frame structure, including a peripheral frame 1, where prefabricated seismic-damping partition wall panels with variable friction energy dissipation function is installed in the peripheral frame 1.

The peripheral frame includes a frame top beam 11, a frame bottom beam 12, a frame left column 13 and a frame right column 14. The frame top beam 11 and the frame bottom beam 12 are equal in length and are parallel. The frame left column 13 and the frame right column 14 are parallel. Ends of the frame top beam 11 and the frame bottom beam 12 are reliably connected to the frame left column 13 and the frame right column 14.

The prefabricated seismic-damping partition wall panel includes two side prefabricated seismic-damping partition wall panels 2 and a plurality of middle prefabricated seismic-damping partition wall panels 4 located between the two side prefabricated seismic-damping partition wall panels 2. The out-plane reliable restraint between the partition wall panel and the peripheral frame is implemented through the steel angle restraining member 6. Specific arrangement distances and positions refer to a current specification and standard. Specifically, the steel angle restraining member 6 is installed between the prefabricated seismic-damping partition wall panel and the peripheral frame to ensure that the prefabricated seismic-damping partition wall panel has a reliable out-plane bearing capacity.

Figure 9A:
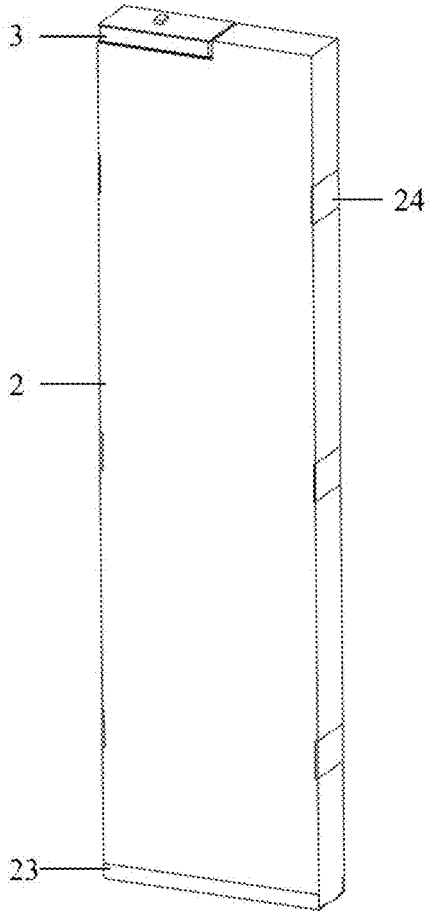
FIG. 9A and FIG. 9B are schematic diagrams of a side prefabricated seismic-damping partition wall panel (FIG. 9A) and an internal structure (FIG. 9B) in the embodiment of the present invention.
Figure 9B:
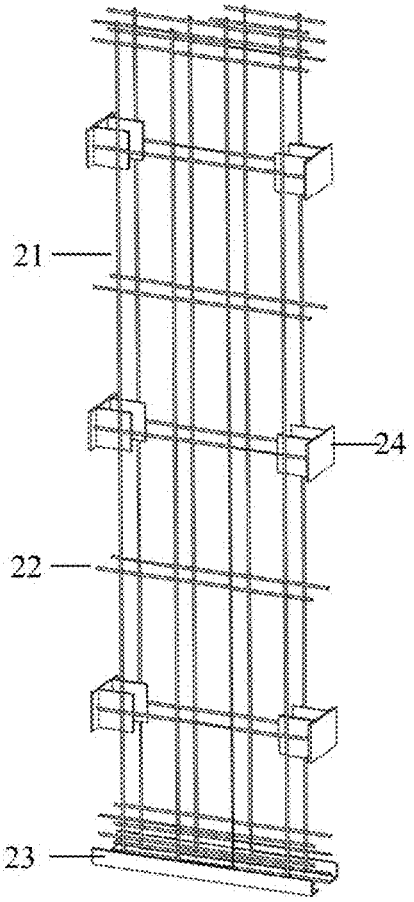

Referring to FIG. 9A and FIG. 9B, an inner framework of each of the side prefabricated seismic-damping partition wall panels 2 includes vertical stress reinforcing bars 21 of a side partition wall panel and transversely distributed reinforcing bars 22 of the side partition wall panel, first edge covered steel angle 23 and first shear members 24. A notch is formed at an upper corner of the side prefabricated seismic-damping partition wall panel, the first edge covered steel angle 23 is arranged on both sides of the bottom, detailing reinforcing bars are provided inside the wall panel and the first shear members 24 are arranged along both sides of a height of the wall panel, and the first shear members 24 in the side prefabricated seismic-damping partition wall panel 2 are in welded connection to second shear members 44 in the adjacent middle prefabricated seismic-damping partition wall panels 4.

Figure 11A:
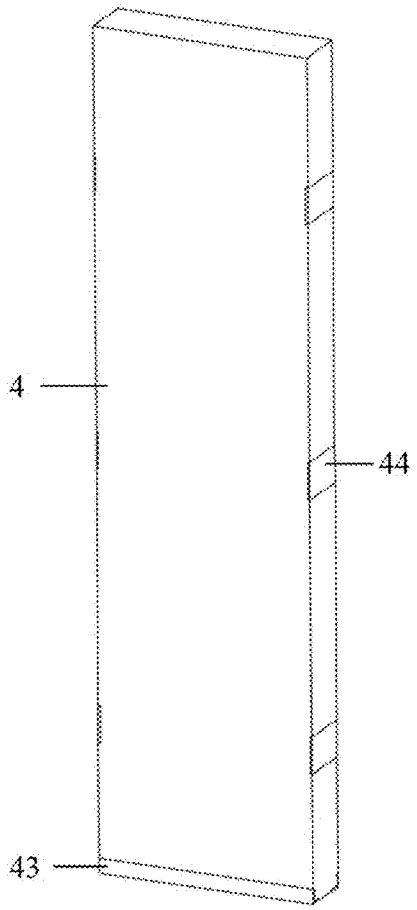
FIG. 11A and FIG. 11B are schematic diagrams of a middle prefabricated seismic-damping partition wall panel (FIG. 11A) and an internal structure (FIG. 11B) in the embodiment of the present invention.
Figure 11B:
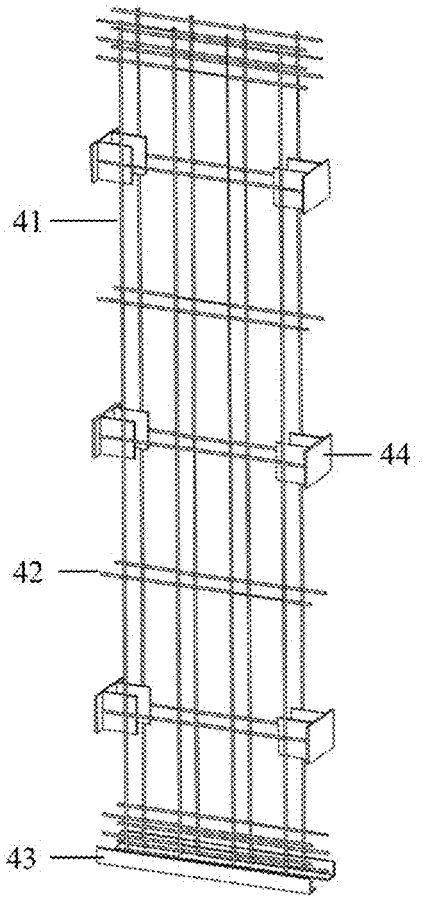

Referring to FIG. 11A and FIG. 11B, an inner framework of each of the middle prefabricated seismic-damping partition wall panels 4 includes vertical stress reinforcing bars 41 of a middle partition wall panel and transversely distributed reinforcing bars 42 of the middle partition wall panel, second edge covered steel angle 43 and second shear members 44. Further, the second shear members 44 in the two middle prefabricated seismic-damping partition wall panels 4 adjacent to each other are in welded connection.

It is to be noted that to avoid severe damage due to stress concentration of the bottom of the partition wall panel under the bidirectional seismic actions, the first edge covered steel angle 23 and the second edge covered steel angle 63 are respectively installed at edges on both sides of the bottoms of the side prefabricated seismic-damping partition wall panel 2 and the middle prefabricated seismic-damping partition wall panel 4. Moreover, to avoid inter-panel interfacial sliding cracks on the wall space of the partition wall, the integrity and the damage controllability of the partition wall are improved by arranging the shear members in the partition wall panel and welded-connecting the shear members between adjacent partition wall panels.

Figure 6:
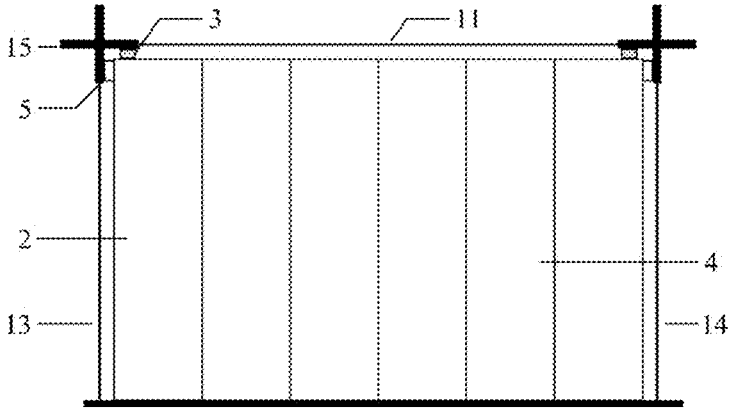
FIG. 6 is a schematic diagram 1 of a mechanism implementing variable friction energy dissipation in the embodiment of the present invention.
Figure 7:
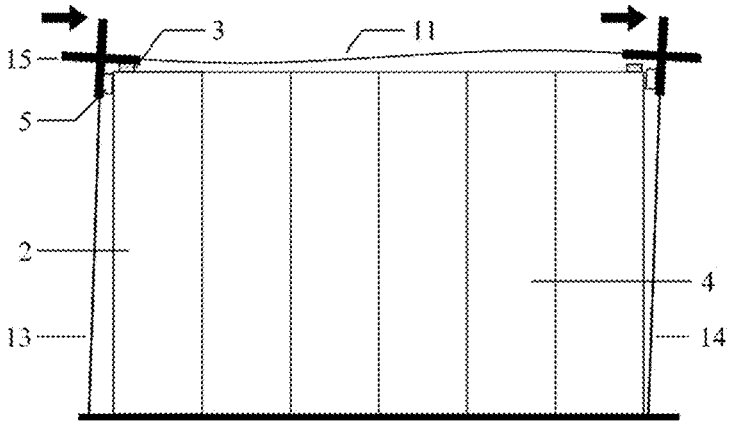
FIG. 7 is a schematic diagram 2 of a mechanism implementing variable friction energy dissipation in the embodiment of the present invention.
Figure 8:
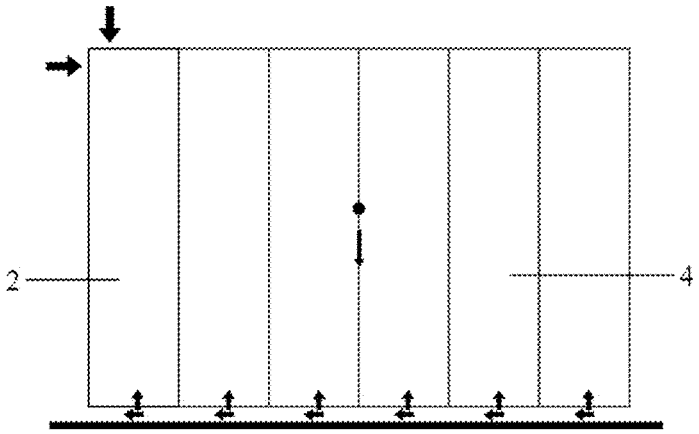
FIG. 8 is a schematic diagram 3 of a mechanism implementing variable friction energy dissipation in the embodiment of the present invention.
Figure 10:
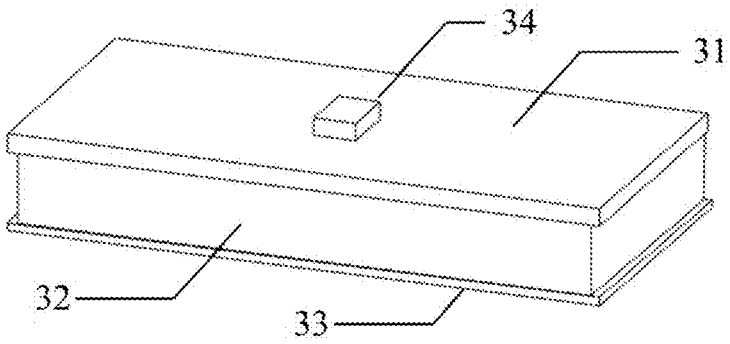
FIG. 10 is a schematic diagram of a rubber pad in the embodiment of the present invention.

Further, to implement the variable friction and variable damping energy dissipation functions, the friction seismic-damping layer 7 is paved among the side prefabricated seismic-damping partition wall panels 2, the middle prefabricated seismic-damping partition wall panels 4 and the frame bottom beam 12, and the friction seismic-damping layer 7 can be made from low strength mortar or other materials with sliding friction energy dissipation functions. The horizontal force transfer members 5 are arranged at the tops of the gaps between the side prefabricated seismic-damping partition wall panel 2 and the frame left column 13 and between the side prefabricated seismic-damping partition wall panel 2 and the frame right column 14. The horizontal force transfer members 5 can be formed by pouring high strength concrete (or high strength mortar) at the gaps through a formwork. Because both side walls of the prefabricated seismic-damping partition wall panel are in contact with the peripheral frame only on the upper portion through the horizontal force transfer members 5, under the horizontal reciprocating force of the seism, the horizontal force transfer members 5 will push the prefabricated seismic-damping partition wall panel to slide with deformation between stories of the peripheral frame 1 without causing collision and extrusion between the bottom of the prefabricated seismic-damping partition wall panel and the peripheral frame (a deformation pattern can refer to FIGS. 6-7), so that the sliding friction energy dissipation of the prefabricated seismic-damping partition wall panel can be implemented. In addition, the notch is formed at the upper corner of the side prefabricated seismic-damping partition wall panel 2. A rubber pad 3 is installed at the notch. The rubber pad 3 is pressed as a result of rotation of the joints and the deformation between stories of the peripheral frame 1, so that the sliding friction of the prefabricated seismic-damping partition wall panel when pushed by the horizontal force transfer members 5 is changed, and therefore, the variable friction and variable damping energy dissipation functions in the earthquake are implemented. Considering that structures are often subjected to biaxial forces during an earthquake, the base of the prefabricated seismic energy-dissipating partition wall with variable friction is allowed to have a certain degree of inclination. Referring to FIG. 10, the rubber pad 3 successively includes an upper closing board 31, rubber 32 and a lower closing board 33 from top to bottom. A protrusion 34 is arranged at a top of the upper closing board 31, and the protrusion 34 is in contact with a bottom surface of the frame top beam 11. The lower closing board 33 is reliably connected to the notch by means of an epoxy adhesive or in other ways. Based on the principle that the rubber pad 3 is controllable and designable in rigidity, the rubber pad 3 shall be uniformly pressed in a stressed state. Therefore, the protrusion 34 is arranged at the top of the upper closing board 31, and the rigidity of the upper closing board 31 can be improved properly (it can be implemented by increasing the thickness of the upper closing board 31). Further, because the protrusion 34 is in contact with the bottom of the frame top beam 11 only in a small range, under the action of the in-plane load or the coupling of the in-plane and out-plane load, the structure of the present invention can prevent the upper closing board 31 from rotating to the maximum extent, so that the rubber 32 is in the approximately and uniformly stressed state all the time.

In combination with FIGS. 5-8 below, the working mechanism of the present invention to implement the variable friction energy dissipation is further explained in the embodiment. Under the action of the horizontal reciprocating force of the earthquake, the frame beam-column joint 15 will translate and rotate. The translation of the frame beam-column joint 15 will drive the horizontal force transfer members 5 to push the partition wall panel to be subjected to friction sliding; due to the rotation of the frame beam-column joint 15, the rubber pad 3 is subjected to compressed deformation which will further presses the partition wall panel, so that the normal force of the friction surface at the bottom of the partition wall panel is improved with increase of inter-story drift and rotation of joints. Therefore, the design allows for the characteristic that the higher the earthquake intensity, the greater the frictional energy dissipation provided by the partition wall.

Embodiment 2

The embodiment discloses a construction method for a variable friction energy dissipation prefabricated seismic-damping partition wall panel. Before the prefabricated seismic-damping partition wall panel is installed, a peripheral frame 1 shall be constructed first. Sundries on a frame top beam 11, a frame bottom beam 12, a frame left column 13 and a frame right column 14 are cleaned. Then, installation position lines are marked in partition wall installation positions with chalk lines (or other tools) according to a construction drawing.

The construction method for a variable friction energy dissipation prefabricated seismic-damping partition wall-frame structure includes the following construction steps:

Step 1:

a side prefabricated seismic-damping partition wall panel 2 is positioned and installed first according to the partition wall installation position lines. During positioning, a wooden wedge is inserted into the bottom of the side prefabricated seismic-damping partition wall panel 2, and the height of the partition wall panel is adjusted by means of tools such as a crowbar, so that the top protrusion 34 of the rubber pad 3 is in contact with a lower flange bottom surface of the frame top beam 11. After accurate positioning, the steel angle restraining members around the side prefabricated seismic-damping partition wall panel 2 are installed to ensure that the partition wall panel has reliable out-plane stability.

Step 2:

A plurality of middle prefabricated seismic-damping partition wall panels 4 are installed, and the step 1 is repeated during installation without considering the position and contact relationship between the rubber pad 3 and the frame top beam 11.

Step 3:

The side prefabricated seismic-damping partition wall panels 2 and the middle prefabricated seismic-damping partition wall panels 4 are finely adjusted till the shear members (the first shear member and the second shear member) on splicing surfaces of the partition wall panels fit well, and in this case, the shear members on the splicing surfaces are welded to complete inter-panel reliable connection of the prefabricated seismic-damping partition wall panels.

Step 4:

Bottom gaps (supported by wooden wedges) of the side prefabricated seismic-damping partition wall panels 2 and the middle prefabricated seismic-damping partition wall panels 4 are packed with friction seismic-damping layers 7 of low strength mortar. The friction seismic-damping layer 7 of low strength mortar is uniform and intact to the greatest extent during packing. After low strength mortar is set and hardened, the wooden wedges at the bottom are extracted and holes left by the wooden wedges are packed with the low strength mortar. Further, high strength concrete (or high strength mortar) is poured into the upper gaps between the side prefabricated seismic-damping partition wall panels 2 and the frame columns to form the horizontal force transfer members 5.

Step 5:

Other gaps between the variable friction energy dissipation prefabricated seismic-damping partition wall panel and the peripheral frame can be packed and filled with a proper flexible material according to requirements on thermal insulation, moisture-proofing, sound insulation and the like.

Embodiment 3

To further demonstrate the beneficial effects and feasibility of this invention, this example constructs an appropriately simplified model based on FIG. 5 and conducts finite element numerical modeling analysis on the assembled seismic energy-dissipating partition wall with variable friction function.

1. Test Piece Design

The sample specimen is the variable friction energy dissipation prefabricated seismic-damping partition wall-frame structure as described in embodiment 1. The control specimen has an identical outer frame size as in embodiment 1 but features a partition wall without the variable friction energy dissipation capability. This partition wall's specific construction is similar to the existing technical solution (Patent No. CN 202210367123.3) and functions as a constant friction damping wall panel. In the two specimens, the gaps between the partition wall and the frame left column 13, between the partition wall and the frame right column 14, between the partition wall and the frame top beam 11 are respectively set as 50 mm, 50 mm and 50 mm. The frame left column 13 and the frame right column 14 are Q355-B welded box columns, with the section sizes of 300×300×14×14 mm. The frame top beam 11 and the frame bottom beam 12 are Q235-B hot-rolled H profile steel, with the section sizes of 400×200×8×13 mm. The structural design meets the requirements on seismic-resistance checking calculation of strong column weak beam, slenderness ratio limiting values of columns and beam-column joint panels.

2. Finite-Element Numerical Value Model Construction

Figure 12:
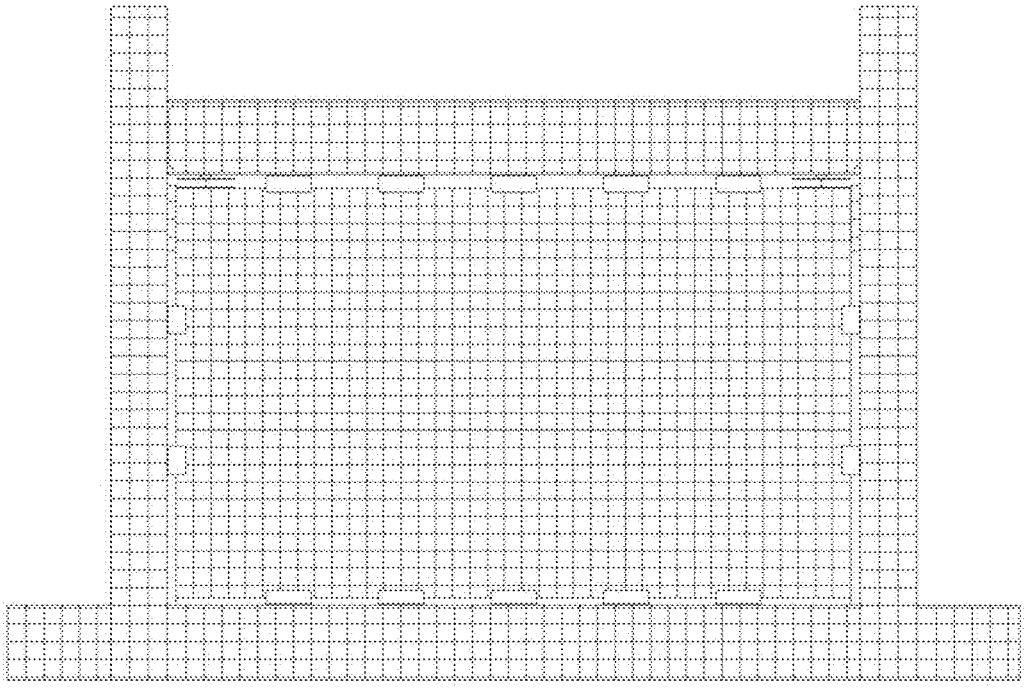
FIG. 12 is a schematic diagram of definite element modeling of a sample specimen in an embodiment 3.
Figure 13:
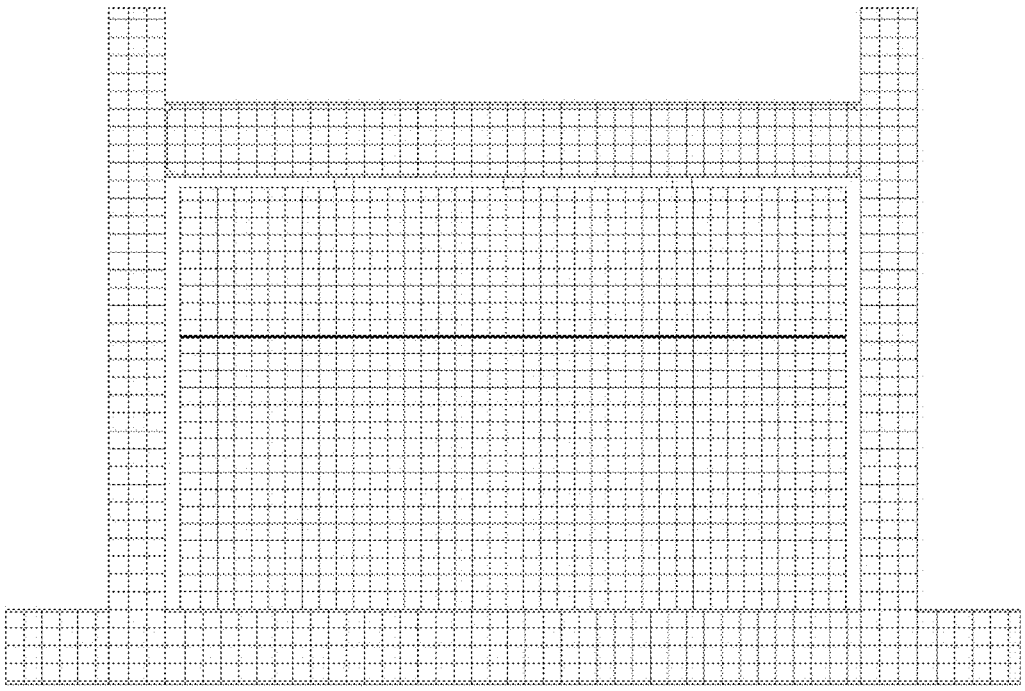
FIG. 13 is a schematic diagram of definite element modeling of a control specimen in the embodiment 3.

According to the actual size and fine structure of the sample specimen, finite-element numerical models of the sample specimen and the control specimen according to a conventional method by using universal finite-element software ABAQUS, where the finite-element model of the sample specimen is shown in FIG. 12, and the finite-element model of the control specimen is shown in FIG. 13.

Key points to construct the finite-element models shown in FIG. 12 and FIG. 13 are briefly described below.

2.1 Peripheral Frame

The peripheral frame based on a steel structure is modeled with a three-dimensional solid element C3D8R, and the frame beams are in restrained connection to the frame columns through Tie. The steel constitutive relationship uses a bilinear kinematic hardening model, where the elasticity modulus E is 206000 MPa, the second rigidity Et is 0.02E, and the Poisson's ratio is 0.28. For Q235 steel, the yield strength is 270 MPa, and the ultimate strength is 425 MPa; for Q355 steel, the yield strength is 379 MPa, and the ultimate strength is 517 MPa.

2.2 Prefabricated Seismic-Damping Partition Wall Panel

The prefabricated seismic-damping partition wall panel is modeled with the three-dimensional solid element C3D8R and is manufactured from an autoclaved aerated concrete material. Therefore, the constitutive relationship of the partition wall is calculated according to the constitutive relationship of autoclaved aerated concrete suggested by Zhenhai GUO, the damage factor is calculated according to an energy method, the elasticity modulus is 2000 MPa and the Poisson's ratio is 0.2. The pressure can be calculated according to equations (1) and (2), and the tensile can be calculated according to equations (3) and (4).

A Pressed Constitutive Relationship:

$$\text{When } \varepsilon_c/\varepsilon_{c0} \leq 1, \sigma_c/f_c = 1.1(\varepsilon_c/\varepsilon_{c0}) - 0.1(\varepsilon_c/\varepsilon_{c0})^2 \quad (1)$$

$$\text{when } \varepsilon_c/\varepsilon_{c0} > 1, \sigma_c/f_c = 1.1(\varepsilon_c/\varepsilon_{c0}) - 0.1(\varepsilon_c/\varepsilon_{c0})^2 \quad (2)$$

in equations (1) and (2), $\sigma_c$ and $\varepsilon_c$ are respectively compressive stress and compressive strain of autoclaved aerated concrete; $f_c$ is peak compressive stress which is 3.5 MPa; $\varepsilon_c 0$ is peak compressive strain which is 0.002; $\alpha$ s an adjustment coefficient with a value range of 2.5-5.0.

A Tensile Constitutive Relationship:

$$\varepsilon_{tu} = 15\varepsilon_{t0} \quad (3)$$

$$f_{tu} = 0.1 f_t \quad (4)$$

In the equations (3) and (4), $\varepsilon_{tu}$ is ultimate tensile strain of the autoclaved aerated concrete, $\varepsilon_{t0}$ is peak tensile strain of the autoclaved aerated concrete, which is 0.0001; $f_{tu}$ is a tensile strength corresponding to ultimate tensile strain; and $f_t$ is peak tensile strength corresponding to the peak tensile strain.

The reinforcing bars in the partition wall are modeled with HPB300 reinforcing bars by using the T3D2 truss elements, where the diameter is 6 mm, the elasticity modulus is 206000 MPa, the Poisson's ratio is 0.3, the yield strength is 300 MPa, the ultimate strength is 420 MPa and the corresponding plastic strain is 0.057. A restraining relationship is established between the reinforcing bars and the partition wall by means of an Embedded command. In addition, with reference to a modeling method in the existing technical solution, the friction seismic-damping layer 7 between the prefabricated seismic-damping partition wall panel and the frame bottom beam 12 is modeled simply, the interfacial normal behavior is defined as hard contact, the tangential behavior is defined as friction contact, and the friction coefficient is 0.7.

2.3 Rubber Pad

The rubber pad 3 in the embodiment is designed with reference to *Rubber Support-Part 3: Seism Isolating Support of Buildings* (GB 20688.3-2006), and the vertical rigidity of the rubber pad 3 is 10 kN/mm. To improve the convergence and calculating efficiency of finite-element numerical value calculation, the rubber pad 3 in the model is modeled simply, the rubber 32 is equivalent to a linear spring with the rigidity of 10 kN/mm, and the spring is connected to the rigid upper closing board 31 and the rigid lower closing board 33. For a contact relationship, the protrusion 34 is in hard contact with the bottom of the frame top beam 11, and the lower closing board 33 is in Tie restraining connection to the side prefabricated seismic-damping partition wall panel 2.

2.4 Other Parts

Besides the parts in 2.1, 2.2 and 2.3, other parts such as the shear members, the edge covered steel angle and steel angle restraining members in the embodiment are endowed with attributes according to the Q235 steel constitutive relationship. The material attribute of the horizontal force transfer members 5 is defined according to C80 concrete in the *Design Specification of Concrete Structure* (GB50010-2002).

2.5 Supplementary Instruction and Loading

The above unspecified contact relationships all are defined and simplified according to actual contact behaviors. The most significant characteristic of the sample specimen and the control specimen is implementation of the variable friction energy dissipation. During finite-element numerical analysis calculation, loading of the sample specimen and the control specimen is implemented in two analysis steps: I, a gravity load is applied to the partition wall; and II, a horizontal reciprocating load is applied to the tops of the frame left column 13 and the frame right column 14.

3 Test Results

Figure 4:
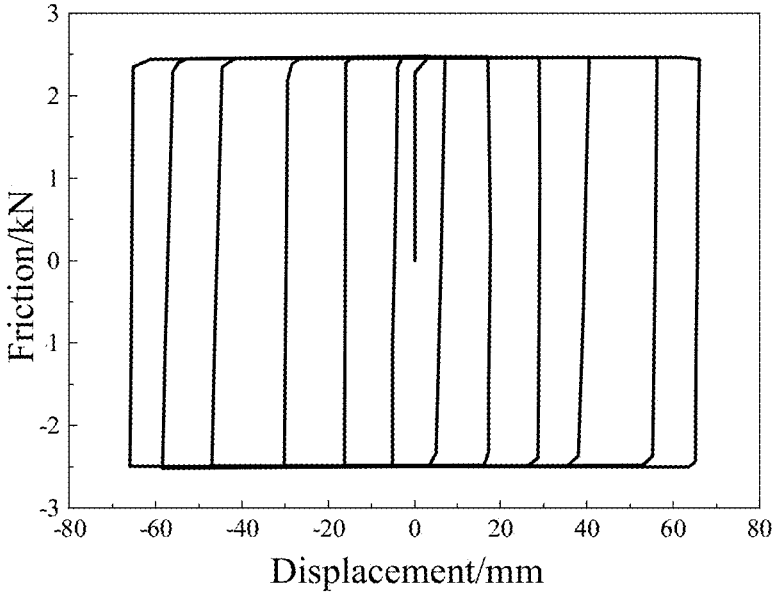
FIG. 4 is a schematic diagram of a calculated result of a finite-element numerical result of a typical friction-displacement curve in the existing technical solution.
Figure 14:
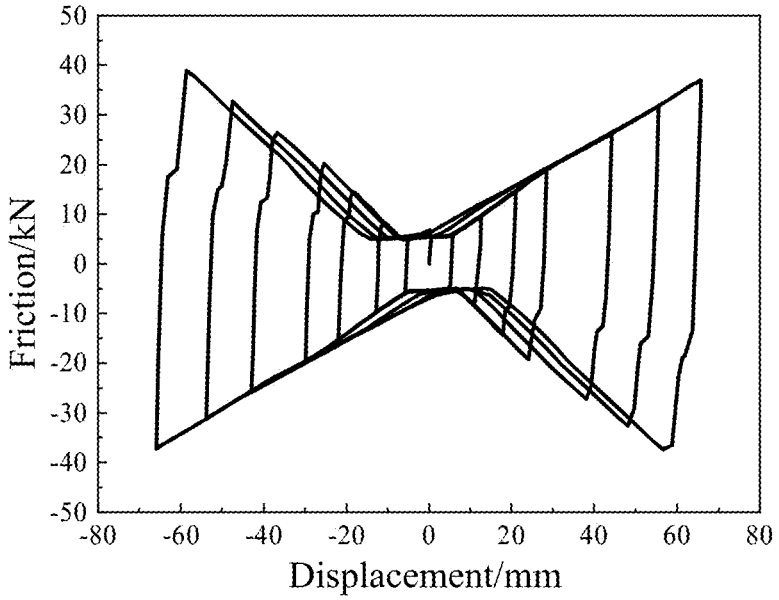
FIG. 14 is a schematic diagram of a calculated result of a finite-element numerical value of a typical friction-displacement curve in the present invention.

Under the horizontal reciprocating load action, the friction-displacement curve of the constant friction seismic-damping partition wall in the existing technical solution is flatly rectangular, with relatively small hysteretic area and limited energy dissipation capacity, as shown in FIG. 4. However, the friction-displacement curve of the variable friction energy dissipation prefabricated seismic-damping partition wall provided by the present invention is butterfly-shaped (as shown in FIG. 14), and the curve is more symmetrical and fuller. The friction is improved with increase of the inter-story drift. Therefore, in present invention, the hysteretic area is relatively larger, the energy dissipation capacity is higher, and a relatively high additional damping ratio can be provided to the structure, so that the seismic action is alleviated.

Although specific embodiments of the present invention are described in conjunction with the accompanying drawings, the scope of protection of the present invention is not limited, it should be apparent to those skilled in the art that on the basis of the technical solution of the present invention, various modifications or variations that can be made by those skilled in the art without inventive step are still within the scope of protection of the present invention.

What is claimed is:

1. A variable friction energy dissipation prefabricated seismic-damping partition wall-frame structure, comprising a peripheral frame, prefabricated seismic-damping partition wall panels with variable friction energy dissipation function arranged in the peripheral frame, shear members, rubber pads, horizontal force transfer members, steel angle restraining members, and a friction seismic-damping layer, wherein the prefabricated seismic-damping partition wall panels comprises two side prefabricated seismic-damping partition wall panels and a plurality of middle prefabricated seismic-damping partition wall panels located between the two side prefabricated seismic-damping partition wall panels, wherein the shear members are arranged between the side prefabricated seismic-damping partition wall panels and the middle prefabricated seismic-damping partition wall panels and between adjacent middle prefabricated seismic-damping partition wall panels, the adjacent shear members fit closely and are reliably connected, each of the rubber pads is arranged between a top of each of the side prefabricated seismic-damping partition wall panels and the peripheral frame, and each of the horizontal force transfer members is arranged in a gap between a side wall of a top end of each of the side prefabricated seismic-damping partition wall panels and the peripheral frame;

each of the steel angle restraining members is arranged between the prefabricated seismic-damping partition wall panel and the peripheral frame to form an out-plane reliable restraint; and the friction seismic-damping layer is arranged at bottoms of the prefabricated seismic-damping partition wall panels.

2. The variable friction energy dissipation prefabricated seismic-damping partition wall-frame structure according to claim 1, wherein an upper corner of the side prefabricated seismic-damping partition wall panel is provided with a notch, and the rubber pad is arranged at the notch.

3. The variable friction energy dissipation prefabricated seismic-damping partition wall-frame structure according to claim 1, wherein each of the side prefabricated seismic-damping partition wall panels comprises a reinforcing bar, and first edge covered steel angle and first shear members connected to the reinforcing bar, the first edge covered steel angle being located on both sides of a bottom of the side prefabricated seismic-damping partition wall panel and the first shear members being arranged along both sides of a height of the wall panel.

4. The variable friction energy dissipation prefabricated seismic-damping partition wall-frame structure according to claim 1, wherein each of the middle prefabricated seismic-damping partition wall panels comprises a reinforcing bar, and second edge covered steel angle and second shear members connected to the reinforcing bar, the second edge covered steel angle being located on both sides of a bottom of the middle prefabricated seismic-damping partition wall panel and the second shear members being arranged along both sides of the height of the wall panel.

5. The variable friction energy dissipation prefabricated seismic-damping partition wall-frame structure according to claim 1, wherein the friction seismic-damping layer is made from low strength mortar or other materials with a sliding friction energy dissipation function.

6. The variable friction energy dissipation prefabricated seismic-damping partition wall-frame structure according to claim 1, wherein the horizontal force transfer clamping member is cuboid and is formed by pouring high strength concrete or high strength mortar through a framework.

7. The variable friction energy dissipation prefabricated seismic-damping partition wall-frame structure according to claim 1, wherein other gaps between the prefabricated seismic-damping partition wall panel and the peripheral framework are filled with a flexible material.

8. The variable friction energy dissipation prefabricated seismic-damping partition wall-frame structure according to claim 1, wherein the rubber pad comprises an upper closing board, a lower closing board, and rubber located between the upper closing board and the lower closing board, the lower closing board being located at the notch, a top of the upper closing board being provided with a protrusion, and the protrusion being in contact with the peripheral frame.

9. The variable friction energy dissipation prefabricated seismic-damping partition wall-frame structure according to claim 8, wherein the lower closing board is adhered and fixed to the notch.

10. A construction method for a variable friction energy dissipation prefabricated seismic-damping partition wall-frame structure according to claim 1, comprising following construction steps:

S1: completing manufacturing of prefabricated seismic-damping partition wall panels in a prefabrication plant, and transporting the prefabricated seismic-damping partition wall panels to a construction site;

S2: completing construction of a peripheral frame, and positioning the prefabricated seismic-damping partition wall panels in the frame;

S3: synchronously installing the prefabricated seismic-damping partition wall panel, friction seismic-damping layer and steel angle restraining members;

S4: installing horizontal force transfer members; and

S5: filling other gaps between the peripheral frame and the prefabricated seismic-damping partition wall panels with a flexible material.

11. The variable friction energy dissipation prefabricated seismic-damping partition wall-frame structure according to claim 2, wherein the rubber pad comprises an upper closing board, a lower closing board, and rubber located between the upper closing board and the lower closing board, the lower closing board being located at the notch, a top of the upper closing board being provided with a protrusion, and the protrusion being in contact with the peripheral frame.

12. The variable friction energy dissipation prefabricated seismic-damping partition wall-frame structure according to claim 11, wherein the lower closing board is adhered and fixed to the notch.

13. The variable friction energy dissipation prefabricated seismic-damping partition wall-frame structure according to claim 3, wherein the rubber pad comprises an upper closing board, a lower closing board, and rubber located between the upper closing board and the lower closing board, the lower closing board being located at the notch, a top of the upper closing board being provided with a protrusion, and the protrusion being in contact with the peripheral frame.

14. The variable friction energy dissipation prefabricated seismic-damping partition wall-frame structure according to claim 13, wherein the lower closing board is adhered and fixed to the notch.

15. The variable friction energy dissipation prefabricated seismic-damping partition wall-frame structure according to claim 4, wherein the rubber pad comprises an upper closing board, a lower closing board, and rubber located between the upper closing board and the lower closing board, the lower closing board being located at the notch, a top of the upper closing board being provided with a protrusion, and the protrusion being in contact with the peripheral frame.

16. The variable friction energy dissipation prefabricated seismic-damping partition wall-frame structure according to claim 15, wherein the lower closing board is adhered and fixed to the notch.

17. The variable friction energy dissipation prefabricated seismic-damping partition wall-frame structure according to claim 5, wherein the rubber pad comprises an upper closing board, a lower closing board, and rubber located between the upper closing board and the lower closing board, the lower closing board being located at the notch, a top of the upper closing board being provided with a protrusion, and the protrusion being in contact with the peripheral frame.

18. The variable friction energy dissipation prefabricated seismic-damping partition wall-frame structure according to claim 17, wherein the lower closing board is adhered and fixed to the notch.

19. The variable friction energy dissipation prefabricated seismic-damping partition wall-frame structure according to claim 6, wherein the rubber pad comprises an upper closing board, a lower closing board, and rubber located between the upper closing board and the lower closing board, the lower closing board being located at the notch, a top of the upper closing board being provided with a protrusion, and the protrusion being in contact with the peripheral frame.

20. The variable friction energy dissipation prefabricated seismic-damping partition wall-frame structure according to claim 19, wherein the lower closing board is adhered and fixed to the notch.

* * * * *